US007611608B2

(12) United States Patent
Hikida

(10) Patent No.: US 7,611,608 B2
(45) Date of Patent: Nov. 3, 2009

(54) PRESS BELT, PROCESS FOR PRODUCING THE SAME AND SHOE PRESS ROLL USING THE PRESS BELT

(75) Inventor: Takahisa Hikida, Hirakata (JP)

(73) Assignee: Yamauchi Corporation, Hirakata-shi (JP)

( * ) Notice: Subject to any disclaimer, the term of this patent is extended or adjusted under 35 U.S.C. 154(b) by 414 days.

(21) Appl. No.: 10/567,366

(22) PCT Filed: Aug. 4, 2004

(86) PCT No.: PCT/JP2004/011140

§ 371 (c)(1),
(2), (4) Date: Feb. 7, 2006

(87) PCT Pub. No.: WO2005/014927

PCT Pub. Date: Feb. 17, 2005

(65) Prior Publication Data

US 2006/0201649 A1 Sep. 14, 2006

(30) Foreign Application Priority Data

Aug. 7, 2003 (JP) ..... 2003-288658

(51) Int. Cl.
*D21F 3/02* (2006.01)

(52) U.S. Cl. ..... 162/358.4; 162/358.3; 162/901; 100/153; 492/20

(58) Field of Classification Search ..... 162/204–207, 162/358.1, 358.3, 358.4, 901; 100/37, 153, 100/156; 492/20, 28, 36, 48, 59
See application file for complete search history.

(56) References Cited

U.S. PATENT DOCUMENTS

| | | | | |
|---|---|---|---|---|
| 4,625,376 | A | 12/1986 | Schiel et al. | |
| 5,943,951 | A * | 8/1999 | Muellner et al. | 100/37 |
| 6,042,695 | A * | 3/2000 | Ishino | 162/358.4 |
| 6,736,939 | B2 * | 5/2004 | Watanabe | 162/358.3 |
| 6,780,287 | B2 * | 8/2004 | Sakuma et al. | 162/358.4 |
| 6,921,461 | B2 * | 7/2005 | Watanabe et al. | 162/358.4 |
| 2002/0028317 | A1 | 3/2002 | Sakuma et al. | |

(Continued)

FOREIGN PATENT DOCUMENTS

EP 0 877 118 A2 11/1998

(Continued)

*Primary Examiner*—Eric Hug
(74) *Attorney, Agent, or Firm*—Birch, Stewart, Kolasch & Birch, LLP

(57) ABSTRACT

A press belt having superior cracking resistance, wear resistance and pressure deflection resistance and an excellent traveling property and a method of manufacturing the same as well as a shoe press employing the same are provided. A press belt in a press comprising a rotatively traveling endless press belt and pressing means, including terminal corresponding areas (B, B') corresponding to both ends of the pressing means in the cross direction and a central area (A) located between the terminal corresponding areas and mainly composed of thermosetting polyurethane obtained from a thermosetting polyurethane material containing a phenylene isocyanate derivative having an isocyanate group (NCO) on an end and a hardener having an active hydrogen group (H) on an end with the equivalent ratio (H/NCO) between the active hydrogen group and the isocyanate group set relatively high on the terminal corresponding areas and relatively low on the central area and a method of manufacturing the same.

10 Claims, 5 Drawing Sheets

U.S. PATENT DOCUMENTS

| | | | |
|---|---|---|---|
| 2004/0029474 | A1 | 2/2004 | Watanabe et al. |

FOREIGN PATENT DOCUMENTS

| | | | | |
|---|---|---|---|---|
| EP | 0 978 588 | A2 | | 2/2000 |
| EP | 1 338 696 | A1 | | 8/2003 |
| JP | 61-179359 | A | | 8/1986 |
| JP | 10-298893 | A | | 11/1998 |
| JP | 2000-110090 | A | | 4/2000 |
| JP | 2002-146694 | A | | 5/2002 |
| WO | WO-02/38859 | A1 | | 5/2002 |
| WO | WO 02/48456 | | * | 6/2002 |

* cited by examiner

PRESS BELT, PROCESS FOR PRODUCING THE SAME AND SHOE PRESS ROLL USING THE PRESS BELT

TECHNICAL FIELD

The present invention relates to a press belt employed for pressing a pressed object in various industries such as the paper industry, the magnetic recording medium manufacturing industry, the textile industry etc. and a method of manufacturing the same, and more particularly, it relates to a press belt for a shoe press and a method of manufacturing the same, as well as a shoe press roll employing the press belt for an outer cylinder.

BACKGROUND ART

Belt pressing of placing a continuous long pressed object on a press belt and pressing the pressed object between a first pressing member located inside the periphery of the press belt and a second pressing member located outside the periphery of the press belt is generally performed in various types of industries. The term "pressing member" denotes a press roll, a pressure shoe or the like. A shoe press employed as a dehydrating press in the paper industry can be listed as an exemplary belt press.

Simply stated with reference to the paper industry, the shoe press is employed for a method of performing pressing (dehydration) by applying an area pressure to a pressed object (wet web) placed on the outer peripheral surface of a press belt through the press belt between a press roll employed as external pressing means located outside the periphery of the press belt and a pressure shoe employed as internal pressing means located inside the periphery of the press belt. While a roll press performing pressing with two rolls applies a linear pressure to the pressed object, the shoe press can apply an area pressure to the pressed object with the pressure shoe having a prescribed width in the traveling direction. When dehydration pressing is performed with the shoe press, therefore, a nip width can be advantageously increased for improving dehydration efficiency.

A shoe press roll prepared by covering a pressure shoe serving as internal pressing means with a flexible cylindrical press belt (press jacket) and assembling the same into a roll in order to compactify a shoe press has come into wide use, as typically disclosed in Patent Document 1, for example.

In addition to the aforementioned dehydration step, shoe pressing may be performed in place of roll pressing or along with roll pressing in a calendering step carried out for smoothing the surface of a pressed object and putting a gloss thereon in order to improve the quality of the pressed object in the paper industry, the magnetic recording medium manufacturing industry, the textile industry etc., for example. Strength, wear resistance, flexibility and nonpermeability with respect to water, oil, gas etc. can be listed as general characteristics required to a press belt. Polyurethane obtained by reacting a urethane prepolymer and a hardener with each other is generally used for the press belt as a material having these characteristics. However, severe bending or pressing is repeated on the press belt, particularly the shoe press belt, and hence the outer periphery of the press belt is easily cracked to result in a serious problem in durability.

As a method of solving the aforementioned problem, Patent Document 2 discloses a shoe press belt improved in wear resistance and cracking resistance by varying the hardness of resin constituting the belt to be high on a cross-directional central area and low on both edge areas including portions corresponding to shoe edges. In this case, the belt conceivably has an effect of maintaining wear resistance and pressure deflection resistance on the central area while rendering the both edge areas hardly crackable.

Cracking is easily concentrically caused on terminal corresponding areas corresponding to both cross-directional ends of pressing means such as a press roll or a pressure shoe. It is conceivable that not very strict cracking resistance is required but wear resistance and pressure deflection resistance must rather be emphasized on a central area located between the terminal corresponding areas for serving as a pressing surface for a pressed object.

While Patent Document 2 has been proposed on the basis of this idea, hardness must be varied to some extent on the central area and the both edge portions in order to compatibly attain wear resistance and cracking resistance by varying the hardness. Contracting force in molding varies with the hardness of polyurethane. When the hardness is remarkably varied on the central area and the both edge portions of the belt, therefore, cylindricity may be deteriorated to hinder the traveling property.

On the other hand, Patent Document 3 discloses a method of preventing cracking by preparing the composition of polyurethane constituting the outer peripheral surface of a press belt so that the equivalent ratio (H/NCO) between an active hydrogen group (H) of a hardener and an isocyanate group (NCO) of a urethane prepolymer is $1<N/NCO<1.15$.

According to this method, the overall press belt can be inhibited from cracking. When the equivalent ratio is set to $1<N/NCO<1.15$, however, wear resistance of the overall press belt is disadvantageously reduced. Particularly in a shoe press belt employed for a dehydrating press of a paper machine, cavities such as grooves or blind holes for draining are formed on the outer peripheral surface of the belt in a sheet width range allowing passage of a wet web, and the cavities are reduced in capacity to reduce drainability when the press belt is worn or pressure-deflected.

Patent Document 1: Japanese Patent Laying-Open No. 61-179359

Patent Document 2: Japanese Patent Laying-Open No. 10-298893

Patent Document 3: Japanese Patent Laying-Open No. 2002-146694

DISCLOSURE OF THE INVENTION

Problems to be Solved by the Invention

An object of the present invention is to solve the aforementioned problems and provide a press belt hardly cracked on terminal corresponding areas corresponding to both cross-directional ends of a pressing member such as a press roll or a pressure shoe and superior in wear resistance and pressure deflection resistance on a central area located between the terminal corresponding areas for serving as a pressing surface for a pressed object with remarkable cylindricity and an excellent traveling property, as well as a shoe press roll employing this press belt as an outer cylinder.

Means for Solving the Problem

The press belt according to the present invention, a rotatively traveling belt having an endless shape, is employed for a method of placing a pressed object on the outer peripheral surface of the press belt for pressing the pressed object with pressing means, located inside the periphery and/or outside the periphery of the press belt, having a prescribed width. In relation to the present invention, it is assumed that the terms "traveling direction" and "cross direction" denote the traveling direction and the cross direction of the pressed object respectively, unless otherwise stated.

The pressed object is a continuous long material such as a wet web, a magnetic tape or woven fabric, and not particularly restricted. The pressing means is a press roll or a pressure shoe.

The press belt is formed to include terminal corresponding areas corresponding to both cross-directional ends of the pressing means and a central area located between the said terminal corresponding areas. The press belt is mainly composed of thermosetting polyurethane (hereinafter simply referred to as "polyurethane"), and this polyurethane is obtained from a thermosetting polyurethane material (hereinafter simply referred to as "polyurethane material") containing a phenylene isocyanate derivative having an isocyanate group (NCO) on an end and a hardener having an active hydrogen group (H) on an end. In relation to the present invention, the term "active hydrogen group" denotes hydrogen contained in an atom group such as OH, SH, $NH_2$ or COOH, for example, easily causing chemical reaction.

A feature of the present invention resides in that the polyurethane material is so prepared that the value of the equivalent ratio (H/NCO) between the active hydrogen group (H) and the isocyanate group (NCO) is set relatively high on the terminal corresponding areas and relatively low on the central area.

Polyurethane obtained from a polyurethane material so prepared that the H/NCO value is high is excellent in cracking resistance but inferior in wear resistance and pressure deflection resistance, while polyurethane obtained from a polyurethane material so prepared that the H/NCO value is low is excellent in wear resistance and pressure deflection resistance but tends to be inferior in cracking resistance. According to the present invention, therefore, polyurethane obtained from a polyurethane material having a relatively high H/NCO value is employed for the easily cracked terminal corresponding areas thereby suppressing cracking, while polyurethane obtained from a polyurethane material having a relatively low H/NCO value is employed for the central area serving as the pressing surface for the pressed object thereby maintaining wear resistance and pressure deflection resistance. In the present invention, hardness may not be remarkably varied on the terminal corresponding areas and the central area, whereby a belt having excellent cylindricity can be easily obtained with no cross-directional unevenness in contracting force in molding of the belt. The difference in hardness between the central area and the terminal corresponding areas is preferably set to less than 1 degree in type A durometer hardness, in order to reduce the possibility of deteriorating the cylindricity.

If unevenness in cylindricity is in a range not hindering the traveling property of the belt, however, the hardness of the terminal corresponding areas may be reduced below that of the central area to provide hardness difference.

In the polyurethane material, the value of the equivalent ratio (H/NCO) between the active hydrogen group (H) and the isocyanate group (NCO) is preferably set to at least 1.01 and not more than 1.14, more preferably to at least 1.08 and not more than 1.14 on the terminal corresponding areas, and preferably set to at least 0.85 and less than 1.08, more preferably to at least 0.92 and less than 1.08 on the central area. Cracking resistance can be sufficiently attained if the value of (H/NCO) is at least 1.01 on the terminal corresponding areas, and minimally required wear resistance can be ensured on the terminal corresponding areas if the value is not more than 1.14. Minimally required cracking resistance can be ensured on the central area if the value of (H/NCO) of the central area is at least 0.85, while excellent wear resistance is attained if the value is less than 1.08.

General sizes of the press belt are about 2 to 15 m in width, about 1 to 30 m in peripheral length and about 2 to 10 mm in thickness. In the press belt according to the present invention, the thickness of the terminal corresponding areas employing a polyurethane material having a high value of the equivalent ratio (H/NCO) is preferably rendered small with respect to the thickness of the central area employing a polyurethane material having a low value of the equivalent ratio (H/NCO). Polyurethane obtained from the polyurethane material having a high value of the equivalent ratio (H/NCO) is characteristically more easily worn than polyurethane obtained from the polyurethane material having a low value of the equivalent ratio (H/NCO). Therefore, a pressure applied to the press belt on the terminal corresponding areas can be reduced for suppressing wear on the terminal corresponding areas by reducing the thickness of the press belt prepared from the polyurethane material having a high value of the equivalent ratio (H/NCO) on the terminal corresponding areas.

The thickness of the thinnest portions in the terminal corresponding areas of the press belt is preferably set to 50 to 98% of the thickness of the thickest portion of the central area. In this case, at least a certain thickness is ensured for the press belt on the terminal corresponding areas, whereby strength necessary for the press belt can be maintained with a small possibility of reducing the quality of the pressed object.

When the press belt is a shoe press belt employed for a dehydrating press of a paper machine, a large number of draining cavities, i.e., grooves or blind holes can be formed on the outer peripheral surface of the belt over the central area and the terminal corresponding areas. Also in this case, the value of the equivalent ratio (H/NCO) of the polyurethane material is set relatively high on the terminal corresponding areas of the belt and set relatively low on the central area so that cracking can be suppressed on the easily crackable terminal corresponding areas while ensuring excellent wear resistance and pressure deflection resistance on the central area serving as the pressing surface for the pressed object, whereby excellent drainability can be kept by maintaining the cavities in shape.

When a large number of draining cavities are formed on the outer peripheral surface of the press belt over the central area and the terminal corresponding areas, the cavities are preferably so formed that the depth of the deepest cavity on the terminal corresponding areas is 1.1 to 3.0 times, for example, the depth of the shallowest cavity located on the central area. While the terminal corresponding areas prepared from the polyurethane material having a high value of the equivalent ratio (H/NCO) are characteristically more easily worn as compared with the central area prepared from the polyurethane material having a low value of the equivalent ratio (H/NCO), at least a certain depth can be ensured for the cavities if the depth of the deepest cavity on the terminal corresponding areas is at least 1.1 times the depth of the shallowest cavity on the central area also when the press belt is worn on the terminal corresponding area, whereby drainability can be inhibited from reduction. If the depth of the deepest cavity on the terminal corresponding areas is not more than 3.0 times the depth of the shallowest cavity on the central area, there is a small possibility that endurance of the cavities is insufficient also on the terminal corresponding areas.

Another feature of the present invention resides in that the press belt according to the present invention is obtained by a manufacturing method including a first step of preparing at least two types of thermosetting polyurethane materials containing phenylene isocyanate derivatives having isocyanate groups (NCO) on ends and hardeners having active hydrogen groups (H) on ends with different equivalent ratios (H/NCO) between the active hydrogen groups (H) and the isocyanate groups (NCO), a second step of distributing the thermosetting polyurethane materials so that the values of the equivalent ratios (H/NCO) between the active hydrogen groups (H) and the isocyanate groups (NCO) are relatively high on the terminal corresponding areas and relatively low on the central area and a third step of hardening the thermosetting polyurethane materials. In this case, at least the outer peripheral surface of the press belt is preferably formed through the second step.

The present invention further relates to a shoe press roll employing the aforementioned press belt. The shoe press roll according to the present invention comprises an outer cylinder formed by an endless belt and a pressure shoe serving as pressing means located inside the periphery of the outer cylinder. The outer cylinder of the shoe press roll is constituted of a press belt having the features of the press belt according to the present invention.

EFFECTS OF THE INVENTION

The press belt according to the present invention is so constituted that the equivalent ratio (H/NCO) between the active hydrogen group (H) and the isocyanate group (NCO) of the polyurethane material is relatively high on the terminal corresponding areas corresponding to both cross-directional ends of the pressing means and relatively low on the central area located between the terminal corresponding areas, whereby cracking is hardly caused on the terminal corresponding areas having been easily cracked in general while wear resistance and pressure deflection resistance are excellent on the central area serving as the pressing surface for the pressed object. Further, the hardness may not be remarkably varied on the terminal corresponding areas and the central area, whereby a belt having excellent cylindricity can be obtained with no cross-directional unevenness in contracting force in molding of the belt and the traveling property is improved. The press belt according to the present invention is suitably employed as an outer cylinder of a shoe press roll.

DESCRIPTION OF THE REFERENCE SIGNS

1, 3 pressing means, 2, 2*a*, 2*b*, 2*c*, 2*d* press belt, 4 felt member, 5 wet web, 6, 8 pressing surface, 7, 7', 9, 9' both ends, 10 fabric base, 11 polyurethane layer, 12, 13, 13', 14, 14', 15, 16, 16', 17, 17', 18, 19, 19', 20, 20', 22, 23, 23', 24, 24' polyurethane, 21, 25, 26, 26' cavity, 30 shoe press roll, 31 support shaft, 32 hydraulic cylinder, 33 end disc, 34 bearing, 35 fixing plate, 36 outer periphery, 40 test piece, 41 holding member, 42 metal shaft, 43 nozzle, A central area, B, B' terminal corresponding area, C, C' endmost area.

BEST MODES FOR CARRYING OUT THE INVENTION

Embodiments of the present invention are now specifically described with reference to the drawings.

Figure 1:
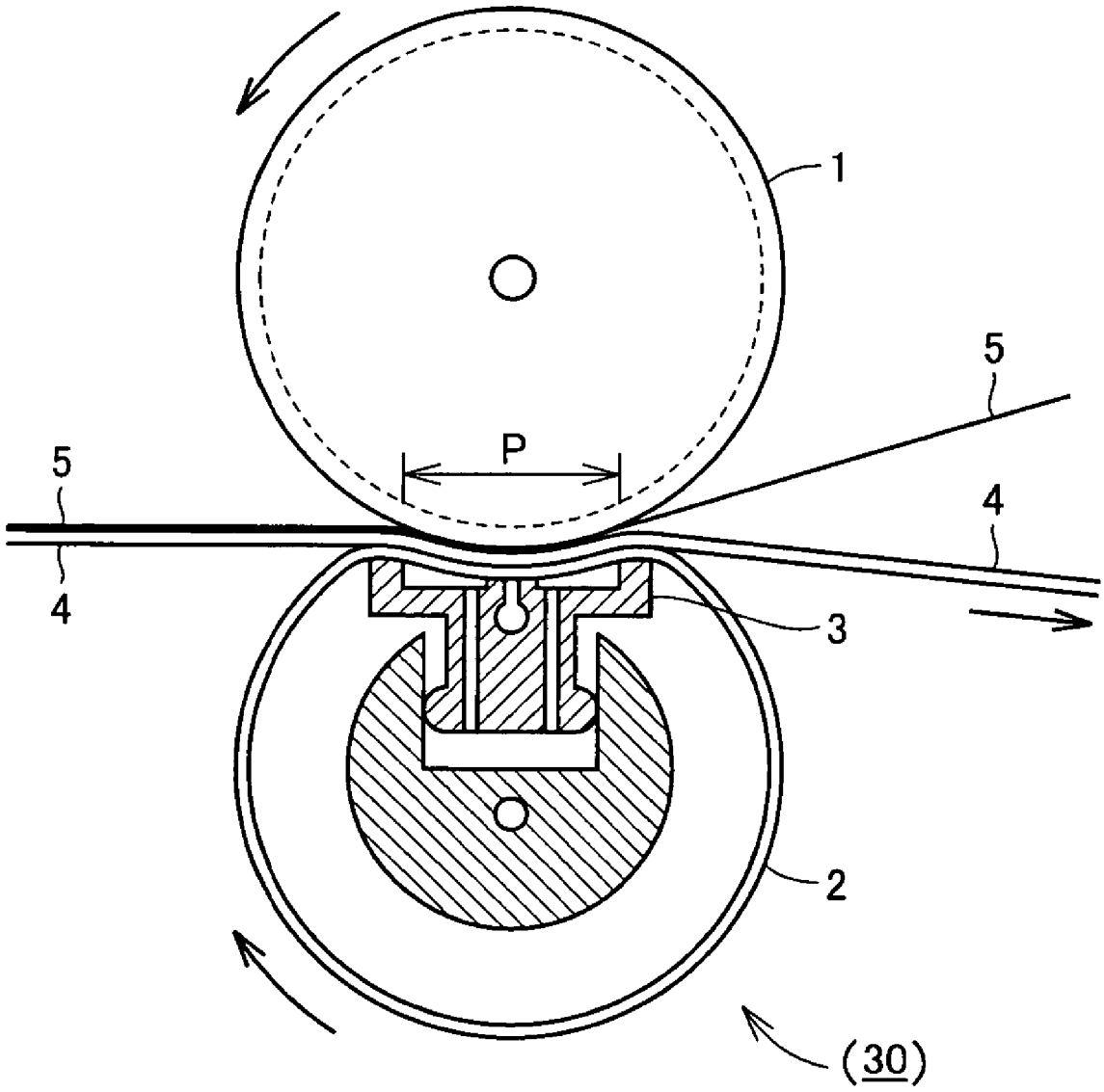
[FIG. 1] A diagram showing a section along the traveling direction of a shoe press employed in a pressing step of a paper machine.

FIG. 1 is a diagram showing a section along a traveling direction of a shoe press employed in a pressing step of a paper machine. Referring to FIG. 1, the shoe press comprises a press roll serving as pressing means 1, a press belt 2 opposed to the press roll and a pressure shoe serving as pressing means 3 located inside the periphery of the press belt 2. While the pressure shoe is covered with the press belt 2 and the press belt 2 is assembled in the form of a roll as an outer cylinder to constitute a shoe press roll 30 in the apparatus shown in FIG. 1, the press roll 2 may not be assembled in the form of a roll but may alternatively be used in the state of an endless belt. The press roll is located outside the periphery of the press belt 2, to function as first pressing means. The pressure shoe is located inside the periphery of the press belt 2, to function as second pressing means. A wet web 5 employed as a pressed object is passed between the press belt 2 and the press roll in a state superposed on a felt member 4. The outer peripheral surface of the press belt 2 and the felt member 4 are directly in contact with each other. Lubricating oil is supplied between the press belt 2 and the pressure shoe, so that the press belt 2 can slide on the pressure shoe. The press roll rotates in a driving manner, while the press belt 2 rotates in a driven manner while sliding on the pressure shoe due to frictional force between the same and the traveling felt member 4. The pressure shoe is pressed against the press roll from the inner peripheral surface of the press belt 2, for pressing and dehydrating the wet web 5 with this pressing force. The surface of the pressure shoe is concaved in correspondence to the surface of the press roll. Therefore, a pressing/dehydrating part P having a large width in the traveling direction is formed between the press roll and the press belt 2.

Figure 2:
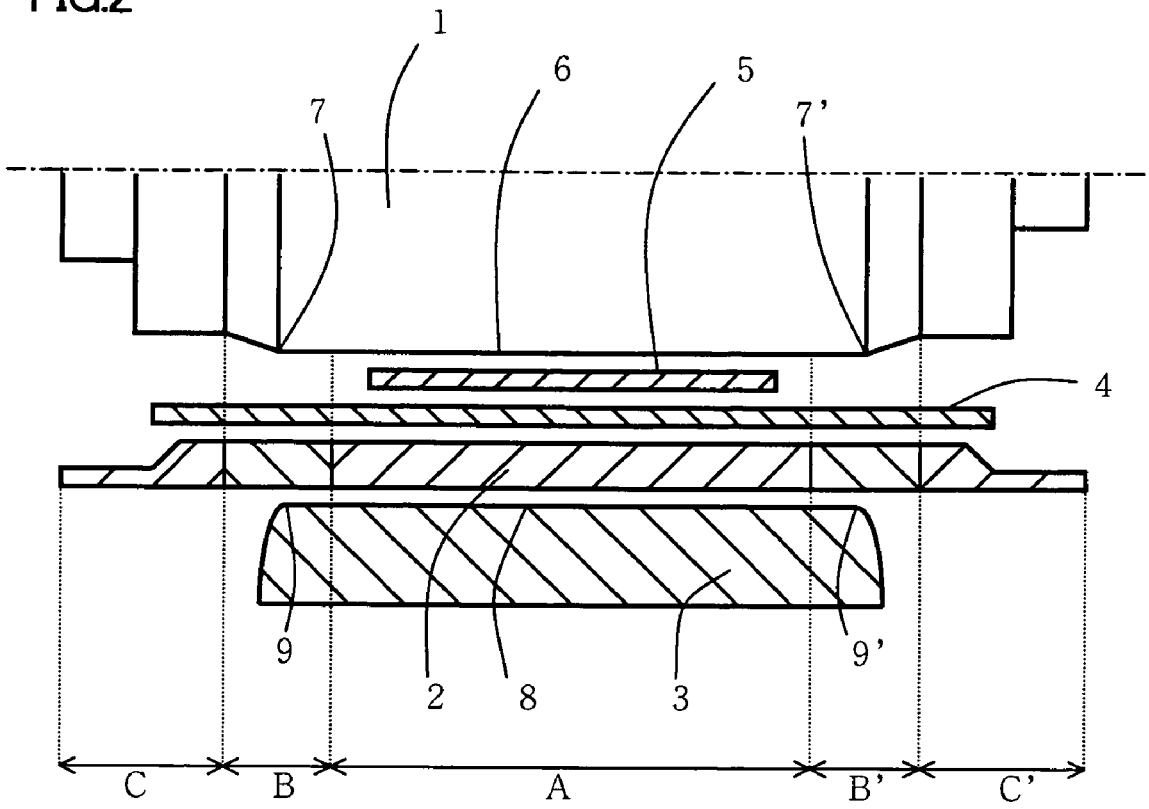
[FIG. 2] A sectional view of a principal part showing a cross-directional section of a pressing/dehydrating part P in FIG. 1.

FIG. 2 is a sectional view of a principal part showing a cross-directional section of the pressing/dehydrating part P in FIG. 1. As shown in FIG. 2, the press roll serving as the pressing means 1 and the pressure shoe serving as the pressing means 3 have prescribed lengths in the cross direction. The press belt 2 has a central area A, terminal corresponding areas B and B' and endmost areas C and C'. The terminal corresponding areas B and B' are areas corresponding to portions including both ends 7 and 7' of a pressing surface 6 of the press roll and both ends 9 and 9' of a pressing surface 8 of the pressure shoe. The central area A is an area located between the terminal corresponding areas B and B'. The endmost areas C and C' are areas located beyond the terminal corresponding areas B and B'.

The press belt 2 is generally formed by impregnating and covering an endless reinforcing material of woven fabric, net or thread with polyurethane. While a method of obtaining this polyurethane is not restricted, a method of reacting a urethane prepolymer having an isocyanate group (NCO) on an end and a hardener having an active hydrogen group (H) on an end with each other is preferably employed in a point that a desired polymer can be simply obtained.

The urethane prepolymer is obtained by reacting polyol and a phenylene isocyanate derivative with each other, for example. The polyol is selected from polyether polyol and polyester polyol. For example, polyethylene glycol (PEG), polypropylene glycol (PPG) or politetramethylene glycol (PTMG) can be listed as the polyether polyol. Polycaprolactone ester, polycarbonate, polyethylene adipate, polybutylene adipate or polyhexene adipate can be listed as the polyester polyol. These can be employed singly or as a mixture or a polymer of at least two types of materials, while a modified material such as a silicon modified material, for example, can also be employed.

For example, tolylene diisocyanate (TDI), diphenylmethane diisocyanate (MDI), m-xylene diisocyanate (m-XDI) or naphthalene diisocyanate (NDI) can be listed as the phenylene isocyanate derivative for obtaining the urethane prepolymer. These can be employed singly or as a mixture of at least two types of materials.

The hardener can be employed as a single type of hardener or a mixture of at least two types of hardeners from among polyol, aromatic diol and aromatic diamine hardeners generally employable as hardeners for polyurethane. That illustrated as the said polyol can be used as the polyol hardener. Hydroquinone di(β-hydroxyethyl) ether (HQEE) can be listed as the aromatic diol hardener. 4,4'-methylene-bis-(2-chloroaniline) (MOCA), trimethylene-bis(4-aminobenzoate) (CUA-4), diethyltoluenediamine (DETDA) or dimethylthiotoluenediamine (DMTDA) can be listed as the aromatic diamine hardener.

The polyurethane forming the press belt 2 is obtained from a polyurethane material so prepared that the value of the equivalent ratio (H/NCO) between the active hydrogen group (H) and the isocyanate group (NCO) is relatively high on the terminal corresponding areas B and B' and relatively low on the central area A by varying the ratios of blending of the polyol, the phenylene isocyanate derivative and the hardener on the terminal corresponding areas B and B' and the central area A. More specifically, the value of the equivalent ratio (H/NCO) is set to at least 1.01 and not more than 1.14 in the polyurethane material employed for the terminal corresponding areas B and B' while the value of the equivalent ratio (H/NCO) is set to at least 0.85 and less than 1.08 in the polyurethane material employed for the central area A. The value of the equivalent ratio (H/NCO) is not particularly restricted in the polyurethane material employed for the endmost areas C and C'.

Embodiments of the press belt 2 according to the present invention are now described with reference to FIGS. 3 to 6.

Figure 3:
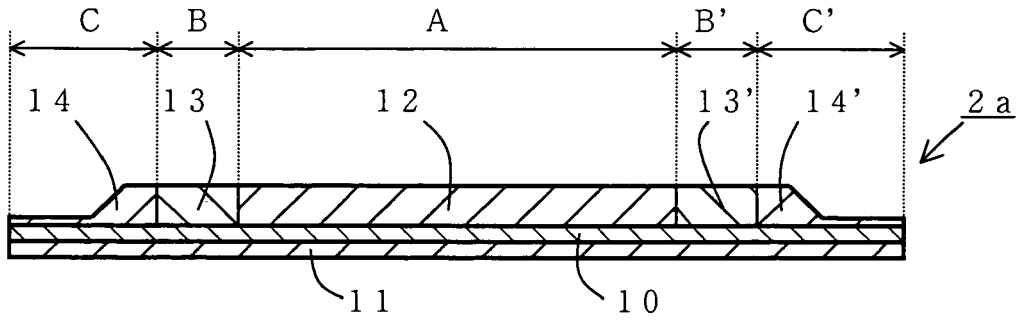
[FIG. 3] A diagram showing a cross-directional section of a press belt according to an embodiment of the present invention.

FIG. 3 is a diagram showing a cross-directional section of a press belt according to an embodiment of the present invention. This press belt 2*a* has a structure obtained by impregnating and covering a fabric base 10 formed by multi-woven fabric serving as a reinforcing material with polyurethane. The inner peripheral surface of the fabric base 10 is uniformly covered with a polyurethane layer 11. The outer peripheral surface of the fabric base 10 is covered with a polyurethane layer 12 located on a central area A, polyurethane layers 13 and 13' located on terminal corresponding areas B and B' and polyurethane layers 14 and 14' located on endmost areas C and C'. Among the polyurethane layers forming the outer peripheral surface, the polyurethane layers 13 and 13' of the terminal corresponding areas B and B' are obtained from a polyurethane material having an equivalent ratio (H/NCO) of at least 1.01 and not more than 1.14, and the polyurethane layer 12 of the central area A is obtained from a polyurethane material having an equivalent ratio (H/NCO) of at least 0.85 and less than 1.08. In the press belt 2*a*, the thicknesses of the central area A and the terminal corresponding areas B and B' are equal to each other. The thickness of the endmost areas C and C' is rendered smaller than those of the remaining areas, so that the press belt 2*a* can be easily mounted on a press machine.

Figure 4:
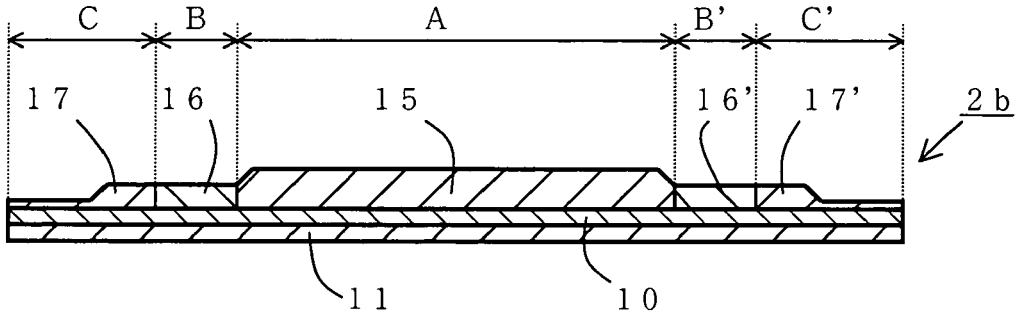
[FIG. 4] A diagram showing a cross-directional section of a press belt according to another embodiment of the present invention.

FIG. 4 is a diagram showing a cross-directional section of a press belt according to another embodiment of the present invention. This press belt 2*b* is a modification of the press belt 2*a* shown in FIG. 3. The press belt 2*b* is different from the press belt 2*a* in a point that the thickness of terminal corresponding areas B and B' is rendered smaller than the thickness of a central area A. In the press belt 2*b*, the outer peripheral surface of a fabric base 10 is covered with a polyurethane layer 15 located on the central area A, polyurethane layers 16 and 16' located on the terminal corresponding areas B and B' and polyurethane layers 17 and 17' located on endmost areas C and C'. The polyurethane layers 16 and 16' located on the terminal corresponding areas B and B' are rendered smaller in thickness than the polyurethane layer 15 located on the central area A, so that the thickness of the press belt 2*b* on the terminal corresponding areas B and B' is 50 to 98% of the thickness on the central area A, for example. The thickness of the endmost areas C and C' is rendered further smaller than that of the terminal corresponding areas B and B', so that the press belt 2*b* can be easily mounted on a press machine. Also in the press belt 2*b*, the polyurethane layers 16 and 16' of the terminal corresponding areas B and B' are obtained from a polyurethane material having an equivalent ratio (H/NCO) of at least 1.01 and not more than 1.14 and the polyurethane layer 15 of the central area A is obtained from a polyurethane material having an equivalent ratio (H/NCO) of at least 0.85 and less than 1.08 in the polyurethane layers forming the outer peripheral surface.

Figure 5:
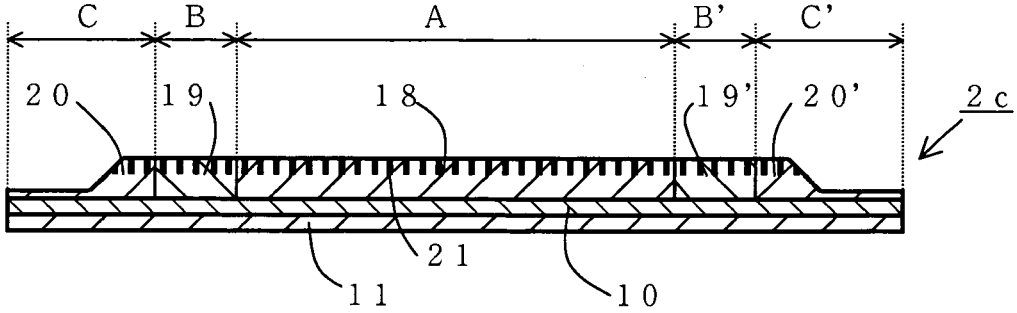
[FIG. 5] A diagram showing a cross-directional section of a press belt according to still another embodiment of the present invention.

FIG. 5 is a diagram showing a cross-directional section of a press belt according to still another embodiment of the present invention. This press belt 2*c* is a modification of the press belt 2*a* shown in FIG. 3. The press belt 2*c* is different from the press belt 2*a* in a point that a large number of cavities 21, i.e., drains are formed on the outer periphery of the press belt 2*c*. In the press belt 2*c*, the outer peripheral surface of a fabric base 10 is covered with a polyurethane layer 18 located on a central area A, polyurethane layers 19 and 19' located on terminal corresponding areas B and B' and polyurethane layers 20 and 20' located on endmost areas C and C'. Also in the press belt 2*c*, the polyurethane layers 19 and 19' of the terminal corresponding areas B and B' are obtained from a polyurethane material having an equivalent ratio (H/NCO) of at least 1.01 and not more than 1.14 and the polyurethane layer 18 of the central area A is obtained from a polyurethane material having an equivalent ratio (H/NCO) of at least 0.85 and less than 1.08 in the polyurethane layers forming the outer peripheral surface.

Figure 6:
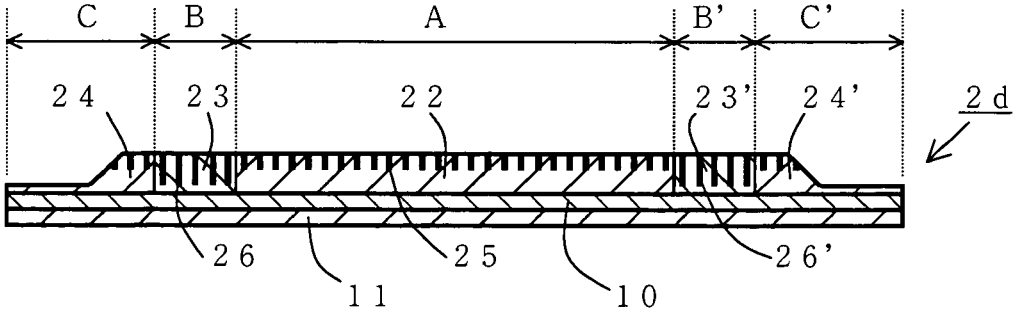
[FIG. 6] A diagram showing a cross-directional section of a press belt according to a further embodiment of the present invention.

FIG. 6 is a diagram showing a cross-directional section of a press belt according to a further embodiment of the present invention. This press belt 2*d* is a further modification of the press belt 2*c* shown in FIG. 5. The press belt 2*d* is different from the press belt 2*c* in a point that the depths of drains vary with cross-directional positions. In the press belt 2*d*, the outer peripheral surface of a fabric base 10 is covered with a polyurethane layer 22 located on a central area A, polyurethane layers 23 and 23' located on terminal corresponding areas B and B' and polyurethane layers 24 and 24' located on endmost areas C and C'. The depth of cavities 26 and 26' in the terminal corresponding areas B and B' is rendered 1.1 to 3.0 times the depth of cavities 25 in the central area A. Also in the press belt 2*d*, the polyurethane layers 23 and 23' of the terminal corresponding areas B and B' are obtained from a polyurethane material having an equivalent ratio (H/NCO) of at least 1.01 and not more than 1.14 and the polyurethane layer 22 of the central area A is obtained from a polyurethane material having an equivalent ratio (H/NCO) of at least 0.85 and less than 1.08 in the polyurethane layers forming the outer peripheral surface.

Figure 7:
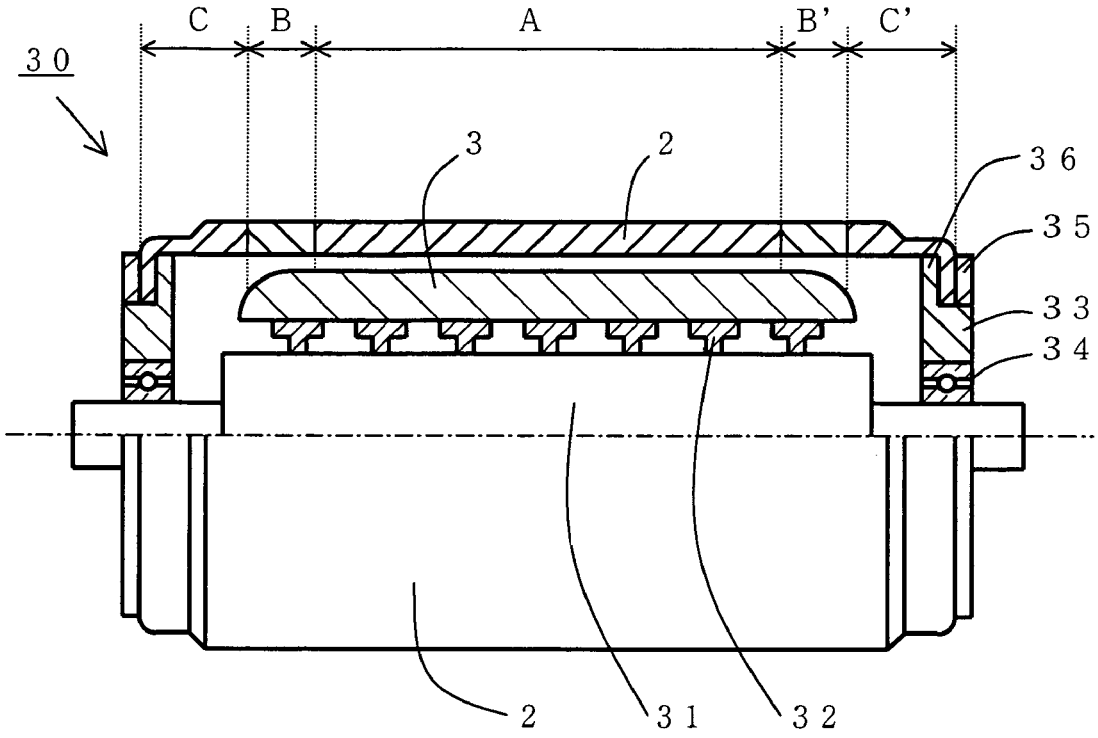
[FIG. 7] A diagram showing a cross-directional section of a shoe press roll according to the present invention.

An embodiment of a shoe press roll according to the present invention is now described with reference to FIGS. 1 and 7. FIG. 7 is a diagram showing a cross-directional section of the shoe press roll according to the present invention. Referring to FIG. 1, this shoe press roll 30 is assembled in the form of a roll by covering a pressure shoe serving as pressing means 3 with a press belt 2 and employing the press belt 2 as an outer cylinder. The pressure shoe, supported by a hydraulic cylinder 32 on a support shaft 31, can press the press belt 2 upward. End discs 33 are rotatably supported on both ends of the support shaft 31 through bearings 34. Edges of the press belt 2 are bent radially inward on the outer peripheries 36 of the end discs 33. The bent portions on the edges of the press belt 2 are held between the outer peripheral portions of the end discs 33 and ring-shaped fixing plates 35, tightened with bolts or the like and fixed. Lubricating oil is supplied between the press belt 2 and the pressure shoe. Thus, the press belt 2 fixed to the end discs 33 can rotate while sliding on the pressure shoe. The press belt 2 can be prepared from that similar to the ones shown in FIGS. 2 to 6. In other words, polyurethane materials so prepared that the values of equivalent ratios (H/NCO) between active hydrogen groups (H) and isocyanate groups (NCO) are relatively high on terminal corresponding areas B and B' and relatively low on a central area A by varying the ratios of polyol, a phenylene isocyanate derivative and a hardener in the terminal corresponding areas B and B' and the central area A are employed for polyurethane layers forming the press belt 2.

The press belt is manufactured by a method including a first step of preparing at least two types of polyurethane materials containing phenylene isocyanate derivatives having isocyanate groups (NCO) on ends and hardeners having active hydrogen groups (H) on ends with different equivalent ratios (H/NCO) between the active hydrogen groups (H) and the isocyanate groups (NCO), a second step of distributing the polyurethane materials so that the values of the equivalent ratios (H/NCO) between the active hydrogen groups (H) and the isocyanate groups (NCO) are relatively high on the terminal corresponding areas and relatively low on the central area and a third step of hardening the polyurethane materials, or the like. The press belt is generally manufactured by impregnating and covering an endless reinforcing base material of woven fabric, net or thread with the polyurethane materials.

While the polyurethane materials containing the phenylene isocyanate derivatives and the hardeners may be directly mixed with each other in the first step, desired polyurethane can be preferably simply and reliably obtained when employing a method employing a urethane prepolymer having an isocyanate group on an end for mixing the urethane prepolymer and a hardener with each other and hardening the mixture.

A method of distributing the polyurethane materials in the second step is not restricted. For example, the polyurethane materials can be distributed by previously preparing a polyurethane material for terminal corresponding areas having a relatively high equivalent ratio (H/NCO) and a polyurethane material for a central area having a relatively low equivalent ratio (H/NCO) in the first step and impregnating the terminal corresponding areas and the central areas of the reinforcing base material with the respective polyurethane materials prepared in the first step.

When the polyurethane materials distributed in the second step are finally thermally hardened in the third step, a press belt formed with desired polyurethane layers on the terminal corresponding areas and the central area can be obtained.

After a single polyurethane material is impregnated into the overall inner peripheral surface of the reinforcing material and thermally hardened, the terminal corresponding areas and the central area of the outer peripheral surface can be further covered with the polyurethane materials having the different equivalent ratios (H/NCO) prepared in the first step. The method of manufacturing a press belt according to the present invention can also include arbitrary steps necessary for manufacturing the press belt such as steps of polishing and cutting the surface of the belt, in addition to the aforementioned steps.

EXAMPLES

While the present invention is now described in more detail with reference to Examples, the present invention is not restricted to these.

First, press belts were manufactured by singly employing polyurethane materials having various equivalent ratios (H/NCO), and subjected to evaluation of cracking resistance, wear resistance etc. Two types of polyurethane materials, i.e., that for terminal corresponding areas and that for a central portion, were selected from those having attained excellent results, and press belts were manufactured with these two types of polyurethane materials.

(1) Manufacturing of Press Belt 1

Quadruple weaving woven fabric materials of 2.5 mm in thickness were prepared as fabric bases. A liquid urethane mixture (H/NCO=0.92) was prepared by mixing 27.4 parts by mass of a hardener (PTMG/DMTDA=65/35, equivalent value=250) into 100 parts by mass of a urethane prepolymer (PTMG-MDI, NCO %=5%) as a material for forming polyurethane layers on the inner peripheral surfaces. This liquid urethane mixture was applied to the surfaces of the fabric bases, the front and back surfaces of which had been inverted, and heated at 80° C. for 10 hours to be hardened. The liquid urethane mixture was impregnated up to about 50% of the thicknesses of the fabric bases. Then, polyurethane layers formed on the fabric bases were cut and abraded so that the thicknesses from the surfaces of the fabric bases were 1.0 mm. Thereafter the front and back surfaces of the fabric bases were so inverted that the coated surfaces formed the inner peripheral surfaces. Then, the outer peripheral surfaces of the fabric bases were impregnated with a liquid urethane mixture of the same composition as that of the polyurethane layers formed on the inner peripheral surfaces, for completely filling the overall fabric bases with polyurethane.

Then, polyurethane materials having different H/NCO values with compositions shown in Table 1 were singly employed respectively for covering the overall outer peripheral surfaces of the fabric bases. Thereafter the overall fabric bases were heated at 127° C. for 16 hours, for completely hardening the polyurethane materials and bonding/integrating the fabric bases and the polyurethane materials to/with each other. Further, the surfaces of the polyurethane layers constituting the outer peripheral surfaces were cut and abraded so that the thicknesses from the surfaces of the fabric bases were 1.5 mm. Further, a large number of drains were formed on the outer peripheral surfaces along the circumferential directions with a groove width of 0.9 mm, a depth of 0.9 mm and a pitch of 2.54 mm. Press belts (samples Nos. 1 to 11) having polyurethane layers, constituting the outer peripheral surfaces, exhibiting type A durometer hardness of 95 on every portion were obtained according to the aforementioned method.

TABLE 1

| | Composition | | H/NCO | Cracking Resistance Test | | Evaluation of Groove Residual Ratio | |
|---|---|---|---|---|---|---|---|
| | Prepolymer (Note 1) | Hardener (Note 2) | (Equivalent Ratio) | Situation of Cracking | Judgment | Groove Residual Ratio | Judgment |
| Sample 1 | 100 | 19.3 | 1.15 | slightly cracked | failure | 32% | failure |
| Sample 2 | 100 | 19.1 | 1.14 | uncracked | good | 34% | failure |
| Sample 3 | 100 | 18.8 | 1.12 | uncracked | good | 38% | failure |
| Sample 4 | 100 | 18.2 | 1.08 | uncracked | good | 42% | fair |
| Sample 5 | 100 | 17.5 | 1.04 | uncracked | good | 45% | fair |
| Sample 6 | 100 | 17.0 | 1.01 | uncracked | good | 48% | fair |
| Sample 7 | 100 | 16.8 | 1.00 | slightly cracked | fair | 50% | good |
| Sample 8 | 100 | 16.1 | 0.96 | slightly cracked | fair | 53% | good |
| Sample 9 | 100 | 15.5 | 0.92 | slightly cracked | fair | 57% | good |
| Sample 10 | 100 | 14.3 | 0.85 | medium cracked | fair | 62% | good |
| Sample 11 | 100 | 13.5 | 0.80 | largely cracked | failure | 66% | good |

(Note 1)
The prepolymer is PTMG-TDI, and NCO % = 6.6%.
(Note 2)
The hardener is DMTDA, and the equivalent value = 107.

(2) Cracking Resistance Test

Figure 8:
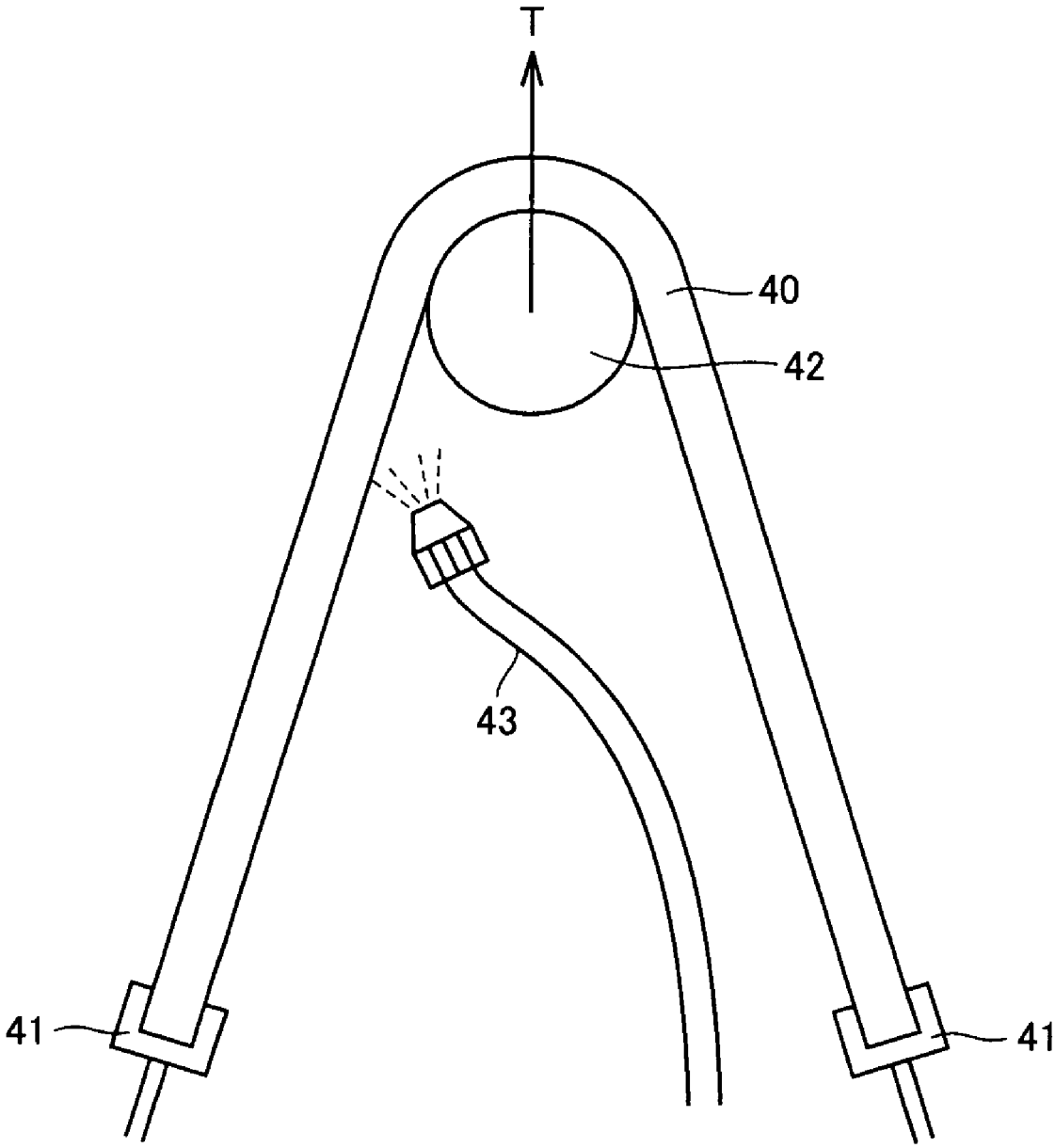
[FIG. 8] A diagram illustrating a method of a cracking resistance test.

FIG. 8 is a diagram for illustrating a method of a cracking resistance test. First, a test piece 40 of 20 mm in width and 420 mm in length was cut from each sample. Then, a metal shaft 42 of 25 mm in diameter having a smooth surface was applied to an inner intermediate portion while grasping both longitudinal ends of the test piece 40 with holding members 41, for applying tension T of 9.8 kN/m to the test piece 40. The test piece 40 was repeatedly reciprocated with a width of 10 cm by moving the holding members 41 while supplying lubricating oil between the inner surface of the test piece 40 and the metal shaft 42 from a nozzle 43 in a state keeping the tension. According to this method, sliding was repeated between the inner surface and the metal shaft 42 while applying the tension to the test piece 40. After two million reciprocations, cracking on the sample surface was visually observed. Table 1 shows the results.

(3) Evaluation of Groove Residual Ratio

As to the respective samples, groove residual ratios under pressure were compared with each other by the following method: In the press belt of each sample, injection type silicone rubber was poured into grooves and hardened while applying a load of 6.9 MPa perpendicularly to the press belt with a compression tester. Then, the hardened silicone rubber was sampled from the grooves, for profiling the grooves under pressure. The volume of the grooves under pressure was measured from the volume of the hardened silicone rubber. The volume of the grooves under pressure with respect to the volume of the grooves in an unpressured state was expressed in percentage as the groove residual ratio under pressure. Table 1 shows the results.

(4) Evaluation of Wear Resistance

The press belts of the sample No. 3 (H/NCO=1.12) and the sample No. 7 (H/NCO=1.00) were mounted on an actual shoe press of a paper machine, for evaluating wear resistance. Use conditions were a traveling speed of 1200 m/min. and a nip pressure of 1000 kN/m. The volumes of the grooves in unpressured states were measured before traveling, after traveling for 30 days, after traveling for 60 days and after traveling for 120 days. Wear resistance was evaluated on the basis of the degrees of reduction of the volumes of the grooves following the running days. The volumes of the grooves after the respective running days were expressed in percentage with reference to 100% of the volumes of the unpressured grooves before traveling. Table 2 shows the results.

TABLE 2

| | H/NCO (Equivalent Ratio) | Evaluation of Wear Resistance (volume of groove (%)) | | | | |
|---|---|---|---|---|---|---|
| | | 0 day | 30 days | 60 days | 90 days | 120 days |
| Sample 3 | 1.12 | 100% | 89% | 83% | 78% | 75% |
| Sample 7 | 1.00 | 100% | 75% | 62% | 59% | 55% |

It is understood that cracking resistance is increased while the groove residual ratio under pressure is reduced as the H/NCO value of the polyurethane material employed for the outer peripheral surface is increased, and that the groove residual ratio under pressure is increased while cracking resistance is reduced as the H/NCO value is reduced. Also considering the results shown in Table 2, it is understood that the difference between the volumes of the grooves resulting from difference H/NCO values gets more remarkable with the days of use of the press belt.

It is suggested from these results that cracking resistance on the terminal corresponding areas and wear resistance on the central area can be compatibly attained by employing a polyurethane material having a relatively high H/NCO value for the terminal corresponding areas while employing a polyurethane material having a relatively low H/NCO value for the central area. Further, a polyurethane material having a composition with the H/NCO value of at least 1.01 and not more than 1.14 is conceivably suitable for the easily cracked terminal corresponding areas B and B', while a polyurethane material having a composition with the H/NCO value of at least 0.85 and less than 1.08 is conceivably suitable for the central area A requiring wear resistance.

(5) Manufacturing of Press Belt 2

The polyurethane material of the sample No. 3 and the polyurethane material of the sample No. 8 were employed for the terminal corresponding areas and the central area respectively, for manufacturing the press belt 2*c* shown in FIG. 5 as follows:

Quadruple weaving woven fabric having a thickness of 2.5 mm was prepared as the fabric base 10. A liquid urethane mixture (H/NCO=0.92) was prepared as the material for forming the polyurethane layer 11 on the inner peripheral surface by mixing 27.4 parts by mass of a hardener (PTMG/DMTDA=65/35, equivalent ratio=250) into 100 parts by mass of a urethane prepolymer (PTMG-MDI, NCO %=5%). This liquid urethane mixture was applied to the surface of the inverted fabric base 10, the front and back surfaces of which had been inverted, and heated at 80° C. for 10 hours to be hardened. The liquid urethane mixture was impregnated up to about 50% of the thickness of the fabric base 10. Then, the polyurethane layer 11 applied to the fabric base 10 was cut and abraded so that the thickness from the surface of the fabric base 10 was 1.0 mm. Thereafter the front and back surfaces of the fabric base 10 were so inverted that the coated surface formed the inner peripheral surface. Then, a liquid urethane mixture of the same composition as that of the polyurethane layer 11 on the inner peripheral surface was impregnated from the outer peripheral surface of the fabric base 10, for completely filling the overall fabric base 10 with polyurethane.

Then, the outer peripheral surface of the press belt 2*c* was covered with polyurethane materials of two types of compositions having different H/NCO values. First, the central area A was coated with a liquid urethane mixture (H/NCO=0.96) prepared by mixing 16.1 parts by mass of a hardener (DMTDA, equivalent value=107) into 100 parts by mass of a urethane prepolymer (PTMG-TDI, NCO %=6.6%). Then, the terminal corresponding areas B and B' were coated with a liquid urethane mixture (H/NCO=1.12) prepared by mixing 18.8 parts by mass of the same hardener to 100 parts by mass of the same urethane prepolymer. Further, the endmost areas C and C' were coated with the same liquid urethane mixture as that of the central area A.

Thereafter the whole substance was heated at 127° C. for 16 hours, for completely hardening the polyurethane materials and bonding/integrating the fabric base and the polyurethane materials to/with each other. Further, the surface of the belt was so cut and abraded that the thickness from the surface of the fabric base 10 was 1.5 mm in the central area A and the terminal corresponding areas B and B' and the thickness from the surface of the fabric base 10 was 0.5 mm in the endmost areas C and C' in the polyurethane layers constituting the outer peripheral surface. In addition, a large number of cavities 21 were formed on the outer surface of the belt along the circumferential direction with a groove width of 0.9 mm, a depth of 0.9 mm and a pitch of 2.54 mm. A belt having a total thickness of 5.0 mm, back surface hardness of 90 in type A durometer hardness and surface hardness of 95 in type A durometer hardness on all of the central area A, the terminal corresponding areas B and B' and the endmost areas C and C' was obtained in the aforementioned method.

When applied to a shoe press of a paper machine, the obtained press belt, prepared from the polyurethane material of the sample No. 3 for the terminal corresponding areas and the polyurethane material of the sample No. 8 for the central area respectively, can conceivably ensure excellent wear resistance and pressure deflection resistance on the central area A while ensuring excellent cracking resistance on the terminal corresponding areas B and B' with reference to the aforementioned results of (2) to (4).

Contracting force in molding was not uneven in the cross direction but cylindricity was excellent due to the same surface hardness on the central area A, the terminal corresponding areas B and B' and the endmost areas C and C'.

The embodiments and Examples disclosed this time must be considered illustrative in all points and not restrictive. The scope of the present invention is shown not by the above description but by the scope of claim for patent, and it is intended that all modifications in the meaning and range equivalent to the scope of claim for patent are included.

INDUSTRIAL APPLICABILITY

The press belt according to the present invention is hardly cracked also on the terminal corresponding areas having been easily cracked in general, and is excellent in wear resistance and pressure deflection resistance on the central area serving as the pressing surface for the pressed object. Further, the terminal corresponding areas and the central area may not be remarkably varied in hardness, whereby contracting force is hardly uneven in the cross direction in molding of the belt. Thus, a belt having excellent cylindricity is obtained and the traveling property is improved when the press belt is employed as a shoe press roll.

The invention claimed is:

1. A press belt in a press comprising a rotatively traveling endless press belt and pressing means located inside the periphery and/or outside the periphery of said press belt, said press belt including terminal corresponding areas corresponding to both ends of said pressing means in the cross direction and a central area located between said terminal corresponding areas, and mainly composed of thermosetting polyurethane obtained from a thermosetting polyurethane material containing a phenylene isocyanate derivative having an isocyanate group (NCO) on an end and a hardener having an active hydrogen group (H) on an end, wherein the equivalent ratio (H/NCO) between said active hydrogen group (H) and said isocyanate group (NCO) is set relatively high on said terminal corresponding areas and relatively low on said central area, wherein the value of said equivalent ratio (H/NCO) is at least 1.01 and not more than 1.14 on said terminal corresponding areas and at least 0.85 and less than 1.08 on said central area.

2. The press belt according to claim 1, wherein the difference in hardness between said central area and said terminal corresponding areas is less than 1 degree in type A durometer hardness.

3. The press belt according to claim 1, wherein the thickness on said terminal corresponding areas is smaller than the thickness on said central area.

4. The press belt according to claim 1, wherein a large number of cavities are formed on the outer peripheral surface over said central area and said terminal corresponding areas.

5. The press belt according to claim 4, wherein the cavities located on said terminal corresponding areas are deeper with respect to the depth of said cavities located on said central area.

6. A shoe press roll comprising an outer cylinder formed by an endless press belt and a pressure shoe serving as pressing means located inside the periphery of said outer cylinder, wherein said outer cylinder is the press belt according to claim 1.

7. A shoe press roll comprising an outer cylinder formed by an endless press belt and a pressure shoe serving as pressing means located inside the periphery of said outer cylinder, wherein said outer cylinder is the press belt according to claim 2.

8. A shoe press roll comprising an outer cylinder formed by an endless press belt and a pressure shoe serving as pressing means located inside the periphery of said outer cylinder, wherein said outer cylinder is the press belt according to claim 3.

9. A shoe press roll comprising an outer cylinder formed by an endless press belt and a pressure shoe serving as pressing means located inside the periphery of said outer cylinder, wherein said outer cylinder is the press belt according to claim 4.

10. A shoe press roll comprising an outer cylinder formed by an endless press belt and a pressure shoe serving as pressing means located inside the periphery of said outer cylinder, wherein said outer cylinder is the press belt according to claim 5.

* * * * *